US012139903B2

(12) United States Patent
Duban

(10) Patent No.: US 12,139,903 B2
(45) Date of Patent: Nov. 12, 2024

(54) DRAIN COVER WITH MESH RETAINING CHANNEL

(71) Applicant: Meshflo Products, LLC, Spring, TX (US)

(72) Inventor: Edmund Duban, Spring, TX (US)

(73) Assignee: Meshflo Products, LLC, Spring, TX (US)

( * ) Notice: Subject to any disclaimer, the term of this patent is extended or adjusted under 35 U.S.C. 154(b) by 203 days.

(21) Appl. No.: 18/152,869

(22) Filed: Jan. 11, 2023

(65) Prior Publication Data

US 2023/0235545 A1 Jul. 27, 2023

Related U.S. Application Data

(60) Provisional application No. 63/267,035, filed on Jan. 21, 2022.

(51) Int. Cl.
*E03F 5/04* (2006.01)
*E03F 5/06* (2006.01)

(52) U.S. Cl.
CPC ..... *E03F 5/041* (2013.01); *E03F 5/06* (2013.01)

(58) Field of Classification Search
CPC ..... E03F 5/041; E03F 5/0411; E03F 5/06
USPC ..... 4/679
See application file for complete search history.

(56) References Cited

U.S. PATENT DOCUMENTS

| | | | | |
|---|---|---|---|---|
| 1,876,127 | A | 9/1932 | Kemper | |
| 3,220,469 | A | 11/1965 | Oehmig | |
| 3,379,237 | A | 4/1968 | Worthington | |
| 3,696,857 | A | 10/1972 | Le Tarte | |
| 4,084,360 | A | 4/1978 | Reckson | |
| 4,452,294 | A | 6/1984 | Fukuchi | |
| 4,631,786 | A | 12/1986 | Curry | |
| 4,631,857 | A | 12/1986 | Kase et al. | |
| 4,658,522 | A | 4/1987 | Kramer | |
| 4,690,192 | A | 9/1987 | Stilling | |
| 4,817,655 | A | 4/1989 | Brooks | |
| 4,899,797 | A | 2/1990 | Green | |
| 5,301,737 | A | 4/1994 | Martin | |
| 5,725,782 | A | 3/1998 | Chinn et al. | |
| 5,904,200 | A | 5/1999 | Agen | |
| 5,954,952 | A * | 9/1999 | Strawser, Sr. | E03F 1/00 210/489 |
| 6,378,267 | B1 | 4/2002 | Bass | |

(Continued)

FOREIGN PATENT DOCUMENTS

| | | |
|---|---|---|
| EP | 2730737 | 5/2014 |

*Primary Examiner* — Lauren A Crane

(74) *Attorney, Agent, or Firm* — Lewis & Reese, PLLC

(57) ABSTRACT

A drain cover assembly that retains mesh on its upper surface via a channel-fastening system that is integrated into the drain cover's perimeter zone. The mesh is retained on the upper surface of the drain cover in a robust and permanent fashion. The drain cover can be configured to provide structural rigidity for supporting a load applied to its upper surface. The drain cover can be adapted to allow for its use in existing or newly constructed drainage system installations. The meshed upper surface of the drain cover can be configured to be flat or raised in profile. The meshed upper surface of the drain cover prevents mosquito habitation and breeding within the associated drainage system and prevents fine debris particles from clogging the drainage system's flow conduit.

20 Claims, 10 Drawing Sheets

(56) References Cited

U.S. PATENT DOCUMENTS

| | | | | |
|---|---|---|---|---|
| 6,706,172 | B2 * | 3/2004 | Strawser, Sr. ..... | B01D 29/05 210/474 |
| 6,945,305 | B1 | 9/2005 | Limauro | |
| 7,005,061 | B1 | 2/2006 | Downs et al. | |
| 7,222,467 | B2 | 5/2007 | Nowell et al. | |
| 7,526,902 | B2 | 5/2009 | Green et al. | |
| 7,861,473 | B1 | 1/2011 | Green | |
| 8,056,602 | B1 | 11/2011 | Green | |
| 8,216,453 | B2 | 7/2012 | Moody et al. | |
| 8,679,328 | B2 | 3/2014 | Hebert | |
| 8,834,714 | B2 | 9/2014 | Chien | |
| 8,980,084 | B2 | 3/2015 | Dorsey | |
| 9,534,417 | B2 | 1/2017 | Green | |
| 10,017,926 | B2 | 7/2018 | Meyers | |
| 10,113,303 | B2 | 10/2018 | Mardian et al. | |
| 10,196,806 | B2 | 2/2019 | Priester | |
| 10,208,884 | B2 | 2/2019 | Honeyball | |
| 10,995,546 | B2 | 5/2021 | Seuberling et al. | |
| 11,332,918 | B2 | 5/2022 | Deurloo et al. | |
| 2004/0128903 | A1 | 7/2004 | Wexler | |
| 2004/0256298 | A1 | 12/2004 | Curtolo | |
| 2005/0016075 | A1 | 1/2005 | Kong | |
| 2005/0081428 | A1 | 4/2005 | Ramsey et al. | |
| 2005/0236120 | A1 | 10/2005 | Johnson | |
| 2006/0102543 | A1 | 5/2006 | Peters, Jr. et al. | |
| 2007/0119554 | A1 | 5/2007 | Guffey | |
| 2017/0284077 | A1 | 10/2017 | Deurloo | |
| 2019/0112873 | A1 | 4/2019 | Randall | |
| 2019/0335737 | A1 | 11/2019 | Dolshun | |

* cited by examiner

DRAIN COVER WITH MESH RETAINING CHANNEL

CROSS REFERENCE TO RELATED APPLICATIONS

This is a non-provisional of U.S. Provisional Patent Application Ser. No. 63/267,035, filed Jan. 21, 2022, which is incorporated by reference, and to which priority is claimed.

FIELD OF THE INVENTION

This invention relates to outdoor drain covers useable in municipal, commercial, and residential drainage systems.

BACKGROUND

Disclosed is a new drain cover having improved functionality that includes the substantial blocking of insects or animals from entering and inhabiting a drainage system, and the substantial blocking of both bulky and fine debris from entering and clogging the drainage system's flow conduit. The term "fine debris," as used herein, shall be understood to include debris particles that are small enough to fit through the surface openings of a typical drain cover while also being large enough to be captured by a mesh (or similar form of filter). The term "outdoor," as used herein, shall be understood to include uncovered areas of a property that are fully exposed to the elements (like backyards or parks) as well as covered areas that are partially exposed (like covered parking lots, porches, or other areas that are not considered part of the interior living area of a residence or building).

Outdoor drainage systems are generally used to collect and transmit drainage water to prevent property flooding. The term "drainage water," as used herein, shall be understood to include stormwater, snow melt water, irrigation runoff water, or other like forms of water that are not otherwise considered a wastewater. The term "wastewater," as used herein, shall be understood to include forms of water that are transmitted into a sewage or septic system, like greywater (from showers or sinks) or blackwater (from toilets). Indoor drainage systems are generally used to collect and transmit wastewater for treatment or disposal. This invention also relates to certain applications for indoor drain covers used in municipal, commercial, and residential drainage systems.

A typical outdoor drainage system arrangement is depicted in FIGS. 1 and 2 (section view). This example shows a known form of a circular drain cover 40 that is used in conjunction with a drainage water transmitting flow conduit 48. The type of flow conduit 48 shown in this example is cylindrical in cross-section and composed of corrugated plastic tubing that may comprise a High Density Polyethylene (HDPE), and that may include an ultraviolet light (UV) inhibitor additive for outdoor use. In general, typical drain covers and flow conduits may vary in form and their materials of construction, as is known to those familiar in the art.

The drain cover 40 in this example contains a plurality of grating members 42 and a corresponding plurality of surface openings 44. The configuration of a drain cover's grating members and surface openings is known to vary according to the manufacturer and application. The maximum width dimension of the surface openings 44 is often limited to be no greater than 5/16" to qualify as "heel safe" per industry practice, or alternatively is limited to be no greater than ½" to qualify as "ADA compliant" per the Americans with Disabilities Act. The open area of the drain cover represents the sum of the individual areas of the surface openings 44. The amount of open area directly affects the drain cover's 40 capacity for allowing drainage water 56 to freely ingress into the flow conduit 48.

The typical drain cover 40 of this example can prevent the passage of bulky debris carried by the drainage water 56, thereby providing the drain system with a means of basic filtration from items like leaves or twigs. The accumulation of bulky debris will eventually block the surface openings 44, thus reducing the amount of open area and restricting the drain cover's 40 drainage water flow capacity. The typical drain cover 40 of this example can also prevent large animals, like rats, from entering the flow conduit 48, but not smaller animals or insects, like small snakes or cockroaches. The grating member 42 grid is typically rigid enough to support some amount of surface loading without collapsing. Some examples of loads that may be applied to a drain cover's surface include all or part of a person's standing weight, or the weight of accumulated debris. The rigidity of the drain cover 40 is dependent on the structural characteristics of the grating member 42 grid and its associated perimeter zone 46. The perimeter zone 46 provides an outer frame for supporting the grating member 42 grid that connects to it.

The drain cover's perimeter zone 46 may have features on its underside for engaging or securing the drain cover 40 to the flow conduit 48. The connectivity features of a drain cover's underside are known to vary according to application. In this example, one known method for connecting the drain cover 40 to a flow conduit 48 is depicted in the form of a tapered neck extension 50. The tapered neck extension 50 allows for the drain cover to be secured via a friction fit with the internal diameter of the flow conduit 48. In this example, a shoulder area 54 is located on the drain cover's 40 underside to serve as a point of support to prevent the drain cover 40 from falling into the flow conduit 48. The drain cover's 40 flat upper surface profile is flush with the surface of the ground 52. The term "ground," as used herein, shall be understood to include the various types of surfaces on a property where drainage water (or wastewater) is to be removed. The process of lifting a drain cover 40 that is flush with the surface of the ground 52 can often require one to insert a hooking device (or finger) through a surface opening 44 to use a point on the grating member 42 for lifting. In general, a flat drain cover profile may be preferable for installation in areas like walkways, where the drain cover would potentially become a tripping hazard were it not flush, or nearly flush, with the surface of the ground 52.

A second example of typical outdoor drainage system arrangement appears in FIGS. 3 and 4. This example features a known form of circular drain cover 58 with a hemispherical grating member 60 grid profile that is raised above the ground 52, making its surface three-dimensional in shape. The surface openings 61 shown in this example are likewise three-dimensional in their form. In general, the profile of a raised drain cover will permit more debris accumulation relative to that of a flat drain cover (of similar size) due to the former's increased open area. The hemispherical grating member 60 grid profile provides approximately twice as much relative open area compared to that of a flat profile drain cover of equivalent diameter (e.g., FIGS. 1 and 2). Additionally, the debris that accumulates around the raised drain cover's 58 base area 59 does not immediately obstruct the surface openings 61, which are mostly above it, thus further enhancing the debris-handling capacity of the drain cover 58. While raised drain covers such as 58 offer enhanced debris-handling capacity compared to flat drain covers, the former also have limitations. Raised drain covers are generally less preferable for use in applications in which it is necessary to support significant surface loads (as the load will be less easily distributed) or in which there will be significant foot traffic (as they pose a tripping hazard risk).

A third example of a typical outdoor drainage system arrangement is provided in FIGS. 5 and 6. In this example a square drain cover 64 is mounted on a square catch basin 62, which in turn is connected to the underground flow conduit 48 via an outlet 76 located on the catch basin 62's wall 70. In this example, a known method for connecting the catch basin's wall 70 to the flow conduit 48 is depicted in the form of a friction-fit, tapered neck extension 72. Like the previous examples, the surface openings 65 will filter only the largest forms of bulky outdoor debris, like leaves and twigs. Other finer forms of outdoor debris, like mulch or gravel, can pass through the surface openings 65 of the drain cover 64. This unfiltered debris may eventually degrade the performance of the drainage system by causing clogs in its flow conduit 48, thereby lowering its capacity for transmitting drainage water 56, which may cause flooding and property damage.

The problem of conduit clogging can be partially addressed by a sump 74 feature provided by the typical catch basin 62 shown in this example. Catch basins may vary in form, and their material of construction, as is known to those familiar in the art. One of the catch basin's 62 primary functions is that of settling-out and capturing some of the fine debris particles that pass through the typical drain cover's surface openings 65. Heavier-than-water fine debris particles (like gravel) will fall into catch basin's sump 74 and thereby be prevented from entering and clogging the drainage system's underground flow conduit 48. However, the catch basin 62 is not effective at capturing lighter-than-water fine debris particles, like mulch. Thus, those particles will enter the flow conduit 48 and may eventually cause conduit clogs. The sump 74 portion of the catch basin 62 must be routinely cleaned to prevent the over-accumulation and spillover of captured debris. The process for cleaning the catch basin's sump 74 is both manual and unpleasant. The water-saturated organic material found in the catch basin's sump 74 will often ferment into a sewage-like sludge which must be scooped out manually as part of the drain system's routine and regular maintenance.

The perimeter zone 67 of the drain cover 64 of this example has a flat underside 68, which is supported on a shoulder ledge 69 located at the top of the catch-basin 62's walls 70. The grid of grating members 63 in this example is rigid and connects with the frame formed by the perimeter zone 67. The typical drain cover 64 of this example also features the use of hold-down screws 71 used to fasten the drain cover 64 to the catch basin 62 to prevent unwanted lifting or vandalism of the drain cover 64. Drain covers that are used in conjunction with catch basins can be either raised or flat in profile, according to the application. This example's drain cover 64 is flat in profile and flush with the ground 52, but could also be raised as shown in FIGS. 3 and 4.

A fourth example of a typical outdoor drainage system arrangement appears in FIG. 7. In this example, a filter basket 78 is used in conjunction with the catch basin 62 of the previous example to address the capturing of lighter-than-water debris particles, like mulch. The filter basket 78 is comprised of a water-permeable fabric or mesh 82 and a support collar 80. The support collar 80 is mounted between the underside of the drain cover 64 in the catch basin's shoulder ledge 69. The support collar 80 may be rigid or moderately flexible. The filter basket 78 extends into the catch basin 62's volume and can be removed from the catch basin for cleaning. The drain cover 64 must first be removed to access and clean the filter basket 78. The filter basket 78 may vary in materials and construction, depending on the application or manufacturer. The cleaning process of the filter basket 78 is marginally better than that of the catch basin sump 74 of the previous example, but the former remains both a manual and unpleasant process. The organic debris captured by the filter basket 78 will still ferment when immersed in the standing drainage water 56 of the catch basin 62. The filter basket 78 must be removed from the catch basin 62 and manually turned inside-out to dispose of the captured debris sludge as part of routine maintenance of the drainage system.

As previously indicated, prevention of property flooding often necessitates the installation of typical outdoor drainage systems like those described in the four previous examples. Unfortunately, these types of typical drainage systems inadvertently function as ideal breeding habitats for biting mosquito insects that are known to carry a host of dangerous human and animal diseases. The mosquito's habitation of a property's drainage system is vastly detrimental to the quality of life of human and animal inhabitants on the property. The presence of biting mosquito insects on a property is, at the very least, a persistent nuisance, and at worst, the cause of disease and suffering. The mosquito species *Aedes aegypti* is particularly noteworthy in this context due to its small size, significant worldwide prevalence, and the many diseases that it spreads. These potentially deadly diseases include Zika, West Nile, Yellow Fever, Dengue, and Chikungunya. *Aedes aegypti* is currently found in significant geographic portions of the United States, and its range is projected to increase with time, due to factors including urbanization and climate change. Other biting mosquito species (particularly from the genera of *Culex* and *Anopheles*) also inhabit vast portions of the United States, and likewise are vectors for bloodborne diseases and parasites.

The cycle of mosquito habitation in typical outdoor drain systems begins when adult mosquitos enter the drain's flow conduit by flying through the large surface openings of a typical drain cover. Once inside the flow conduit (or catch basin), the mosquitos have access to ample shade and standing water for their offspring's larval development. Mosquitos, both male and female, will seek refuge from the outdoor elements by hiding inside the drainage system to avoid dehydration or exposure. Adult female mosquitos will lay their eggs in the standing water found within the drainage system. Some mosquito species, like *Aedes aegypti*, will lay the eggs slightly above the standing water line on a nearby surface (like the inside surface of the catch basin or flow conduit). After the mosquito eggs hatch and develop into adults, they emerge through the surface openings of a typical drain cover and enter the surrounding environment. Eventually, this new generation of mosquitos will bite a human or animal and return to the drainage system to lay eggs. In this manner the mosquitos will detrimentally utilize a typical drain outdoor system (which must also be used to protect a property from flooding) to continually sustain their lifecycle.

The addition of a catch basin to the outdoor drainage system further encourages mosquito habitation and breeding. This is because the catch basin's larger internal volume offers the mosquitos expanded access to shelter and standing water, adding to that which is already accessible within the smaller volume of the flow conduit. Also, the standing water that accumulates in the catch basin's sump will likely contain a store of organic debris, a necessary food source for the mosquito larvae. Additionally, the fermentation gases that are expelled by the catch basin are known to be mosquito attractants. Further, the typical catch basin and its associated drain cover are often colored black for aesthetic reasons, and because this is the standard color for manufacturing UV-inhibited polymer and composite materials. Dark-colored objects that highly contrast with their surroundings, particularly objects colored black, are known to visually attract mosquitos. Also, the use of a typical filter basket in conjunction with the catch basin does not prohibit mosquito habitation, as the filter basket simply lines the inside surface of the catch basin for ease of cleaning and does not diminish the factors contributing to mosquito habitation and breeding.

To limit the amount of standing water in the outdoor catch basin and the potential for mosquito breeding, it is known that weep holes can be drilled in the base of a catch basin's sump to allow the standing water to seep, over time, into the ground. However, the draining of standing water by this method is hindered if the ground is already water-saturated or otherwise impermeable to water. This drainage method may be further impeded by accumulated debris that blocks the weep holes. Alternatively, to mitigate the possibility of standing water in the drainage system, it is known that consistently sloping the flow conduit downward during its installation can be an efficient preventative method. However, the flow conduit often cannot be fully sloped downward due to grading or elevation limitations on the property, therefore leading to still another scenario in which standing-water accumulation in the drain system is inescapable.

Even the temporary absence of standing water in the drainage system does not totally break the mosquito's use of the drainage system for habitation and breeding. The mosquito may still use the shelter provided within a dried-out drainage system to prevent dehydration during hot periods of the day, or likewise to avoid exposure from freezing conditions or strong winds. As regards mosquito species that can lay eggs above a standing water line (like *Aedes aegypti*), these dormant eggs are protected by a specialized cover and can remain viable for many seasons. After the eventual return of rainfall, the dormant eggs are submerged by new standing water and activated, eventually becoming flying adults in one-to-two weeks. This evolutionary strategy helps the mosquito larvae by ensuring they will hatch into a pool that is deeper than that which existed when the eggs were laid, thus allowing more time for their development. This evolutionary strategy also helps the *Aedes aegypti* species by keeping a significant portion of its offspring in a dormant and resistant state, thus reducing the risk of all the larvae simultaneously hatching in a time of drought, which would result in a population collapse.

To limit the habitation and breeding of mosquitos in outdoor drainage systems, it is known that mesh material can be used in conjunction with a typical outdoor drain cover to function as a mosquito barrier. The wire sizes and materials commonly used for mosquito-barrier meshes in windows or screened-in patios, for example, are known to those familiar with the art. One known form of a "do-it-yourself" meshed drain assembly is shown in FIG. 8. This example utilizes plastic zip-ties 83 to affix the mesh 86 to the underside of the flat drain cover 64 shown in the previous examples. The use of zip-ties 83 is an unideal way to fasten mesh 86 to this drain cover 64, as doing so results in holes 85 or tears in the mesh 86, allowing mosquitos to easily ingress and egress, thus defeating the purpose of the mesh 86. This method of mesh 86 fastening is also cumbersome to construct and likely, over time, to lose mesh 86 fixity. This method of mesh 86 fastening further requires an increased maintenance effort to clean the numerous individual pockets 92 now created within the drain cover's surface openings, each of which stands to accumulate compacted debris. Lastly, this type of "do-it-yourself" assembly would be considered by many to diminish the value of a property due to its unpleasing and flimsy appearance.

Other forms of outdoor drain cover assemblies that utilize mesh have been published. One such example is shown in FIG. 9 as depicted in U.S. Pat. No. 1,876,127. This prior art example shows a "mosquito trap" type cover for use in conjunction with "drain piping systems." This device 84 is an assembly of wire mesh 86 stretched over a hollow cylindrical body 88. The top of the cylindrical body 88 features a rolled-edge shoulder 89 for both mechanically securing the mesh 86 and limiting the insertion of the device 84 into the drain pipe 90. The device 84 of this example, however, does not feature a rigid grating grid that can be safely stood upon without risking collapse. Thus, this device 84 would potentially become an open-hole hazard if installed as a drain cover in a municipal, commercial, or residential setting, as any hole 2" or larger in diameter on a walking surface may generally pose a risk as a fall-through or tripping hazard for pedestrians. Even worse, the mesh 86 (or debris which is accumulated on it) would mask the presence of the hole, further increasing the hazard. The accumulation of debris and/or water pressure may also cause the stretched mesh 86 of this device to collapse. Likewise, the mesh 86 of this device is more susceptible to being deformed or punctured due to impacts or surface loads. A further shortcoming resides in the fact that this device 84 is limited to embodiments that are circular in form due to its construction method, thereby precluding its use on drain system applications requiring other shapes. This device 84 is limited to embodiments that are flush with the edge of the flow conduit 90, thereby precluding its use for drain covers that are preferably raised in their surface profile. This device 84 is likewise limited by its rolled-edge shoulder 89 (to retain the mesh), which precludes easy replacement if the mesh is damaged.

Another example of an outdoor meshed drain cover is shown in U.S. Pat. No. 6,706,172. This patent describes a device used to prevent bulky and fine debris, associated with construction projects, from entering outdoor drainage systems. The mesh portion of this device is cut to match the shape of the conventional drain grate and is subsequently fixed to the top surface of the grate with adhesive and a "rubber compound open frame member" superimposed on the surface of the mesh. One disadvantage of this device is its use of adhesive for fixing the mesh to the surface of the drain cover. While adhesive may be suitable for fixing mesh to a drain cover surface for a temporary construction project, such a cover surface generally lacks the permanence and durability offered by a mechanically fastened mesh. Another disadvantage of this device is that the layers of rubber and mesh will add to the height of the drain cover, thus precluding its use in applications that require its complete flushness with the ground. Yet another disadvantage of this device is that it makes lifting of the drain cover extremely difficult, if not impossible, without damage to the mesh. This is because the grating members (which are traditionally used as lifting points for removing the drain cover) are now obscured by the mesh.

Another example of an outdoor drain cover assembly that incorporates a mosquito and debris barrier beneath the surface of the drain cover is shown in U.S. Patent Application Publication 2004/0128903. In its most basic form, this device is like that shown in FIG. 7, but with the filter basket elevated well above the standing water line of the catch basin. This device has a particular focus on use for outdoor municipal drainage system applications. While some municipal catch basins may indeed be tall enough to accommodate the elevated filter basket, this feature would be a significant disadvantage for use in other types of drainage system applications, as some have no catch basin at all, while others operate with a standing water line that sits just beneath the surface of the drain cover—both of which cases would preclude the use of the described elevated filter basket. Like the prior art device shown in FIG. 7, the debris captured in the filter basket is inaccessible for cleaning unless the drain cover is lifted to provide access to the debris-laden filter basket. This requirement is disadvantageous in burdening the property owner with continually disassembling, cleaning, and then reassembling each drainage system that utilizes a filter basket. Such disadvantage is further amplified if the drain cover, or debris-laden filter basket, proves to be heavy or difficult for a person to handle. In the event the drain cover is fastened to the catch basin with hold-down screws, this device suffers the further disadvantage of requiring the availability of a screwdriver for performing the routine disassembly and cleaning. To address this disadvantage, one embodiment of this device incorporates a trap-door feature into the bottom of the filter basket. This feature uses a uses a spring and counterweight system to allow accumulated debris to self-purge into the flow conduit if the filter basket becomes full. One disadvantage of this feature is its reliance on moving parts, as drainage systems that utilize moving parts may be subject to a greater failure rate than those that are static in operation. Another disadvantage of this feature is that the accumulated debris is intentionally passed into the flow conduit (as an alternative to routine disassembly and cleaning), thus increasing the risk of conduit clogs, particularly for residential and commercial drainage systems, which often feature smaller conduits than those used in municipal drainage systems.

There are also examples of outdoor drainage system devices which may be viewed as alternatives to a meshed drain cover. One such device is shown in U.S. Pat. No. 4,631,857, believed to be marketed through the trade name "MosquitoDunks®." This device is a floating larvicide ring that is placed in the standing water of the catch basin or flow conduit. To prevent the larvicide ring from floating away, it is often tied to a string which is itself fastened to the underside of the drain cover. The larvicide rings are composed of a cork material impregnated with the spores of an ecologically friendly bacteria, *Bacillus thuringiensis*, which kills mosquito larvae. The larvicide ring is designed to break apart gradually to spread its bacteria "over a relatively wide area of the surface where the larvae breed." One disadvantage of larvicide rings is that they must be replaced every 30 days to prevent loss of effectiveness, and thus will become a continual expense and maintenance burden for the property owners. Another disadvantage of larvicide rings is that they kill only mosquito larvae, and thus do not prevent adult mosquitos from taking shelter in the drainage system. Likewise, larvicide rings will not prevent fine debris or other animals/insects from entering the drainage system. Furthermore, the drain cover must be lifted each time a new larvicide ring is replaced. This requirement is disadvantageous in burdening the property owner with continually manipulating the drain cover of each drainage system that is utilizing the larvicide rings. This disadvantage is further amplified if the drain cover proves to be heavy or difficult for a person to handle.

Some examples of indoor drain cover assemblies can be found in U.S. Pat. Nos. 10,196,806, 10,113,303, 7,005,061, and 10,017,926. These patents disclose various drain cover devices that could be utilized for removing fine debris particles from wastewater. A drain cover that filters food and trash particles from wastewater created during the cleaning of a commercial kitchen is one such example. Indoor and outdoor drainage generally share some common features and design elements, like drain cover surface openings for allowing water to freely ingress, and grating members for supporting a surface load. The problem of fine debris removal and conduit clogging affects drain covers used in both indoor and outdoor drainage system applications. Likewise, both indoor and outdoor drainage systems are affected by the problem of certain insects (like cockroaches) which may freely move through the surface openings of typical drain covers.

SUMMARY

An object of the presently disclosed invention is to provide a new drain cover for solving the problems previously mentioned with respect to typical prior art drain covers, in part or in whole.

According to various aspects of the invention:

The new drain cover's perimeter zone contains an integrated channel-fastening system for mechanically retaining a mesh on the upper surface of a drain cover without the use of adhesive.

The new drain cover's integrated channel-fastening system allows for the mesh to be conveniently installed and replaced (if damaged).

The new drain cover can be arranged and configured to embody a wide array of drain cover shapes and sizes, enabling the drain cover to be adapted for use in retrofitting many existing types of drainage system installations, or for those that are newly constructed.

The new drain cover can be configured for use in municipal, commercial, and residential applications.

The new drain cover can be configured for use in both indoor and outdoor drainage system applications.

The new drain cover can also be adapted in form to provide a flat upper surface that may be flush with the ground, or alternatively may be configured with a raised upper surface that provides additional open area for filtration capacity.

The new drain cover can be ergonomically and safely lifted without damaging the mesh, which is affixed to its upper surface.

The new drain cover can be configured to qualify as "heel safe" or "ADA compliant," regarding the size of its sub-mesh openings.

The new drain cover features a rigid grating grid to ensure that the mesh is protected from blunt impacts or heavy debris loads. The rigid grating grid is located below the mesh and also provides structural rigidity for supporting surface loads.

The new drain cover's meshed upper surface does not create an open hole hazard as its surface can safely support a surface load.

The new drain cover's meshed upper surface permits the ingress of drainage water or wastewater while filtering both bulky and fine debris, thereby preventing clogs in the drain system's underground conduit.

The new drain cover denies small animals access to the drainage conduit, thereby preventing unwanted animal habitation within the drainage system.

The new drain cover's surface area filters both heavier-than-water and lighter-than-water fine debris without the use of a filter basket or catch basin sump.

The new drain cover may be used in conjunction with a catch basin sump and/or filter basket to provide multiple layers of filtration and protection against clogs in the flow conduit.

The new drain cover filters and retains bulky and fine debris on its meshed upper surface, thereby avoiding the potential for the debris to ferment in the catch basin or flow conduit (where standing water typically present).

The new drain cover's meshed upper surface captures wet debris that can eventually dry in the open air, enabling such debris to be easily cleaned off by means of external brushing, blowing, or hosing, thereby avoiding the need to lift the drain cover for routine cleaning while also avoiding the need to manually excavate wet debris sludge from a catch basin sump or flow conduit.

The new drain cover may optionally utilize hold-down screws to prevent unwanted lifting or vandalizing of the drain cover.

The new drain cover's upper meshed surface does not require the availability of a screwdriver for routine cleaning in instances where hold-down screws are used.

The new drain cover has a pleasing and permanent appearance and does not diminish the aesthetics of property on which it is installed.

The new drain cover permanently denies mosquitos (like *Aedes aegypti*) and other undesirable insects (like cockroaches) access to the property's drainage system for their shelter, habitation, or breeding.

The new drain cover substantially disrupts a mosquito's use of the drainage system for breeding without the use of larvicide rings or other types pesticides.

The new drain cover prevents re-emergence of adult mosquitos which might spawn from eggs that are washed into the drain system with drainage water, thus trapping mosquitos incidentally spawned in this manner.

The new drain cover is reliable in its operation and does not depend on any moving parts.

The new drain cover does not require the use of an elevated filter basket to prevent mosquito habitation and breeding within the drainage system.

The new drain cover's upper surface may accommodate both loosening-prone and loosening-resistant mesh. The term "loosening-resistant mesh," as used herein, shall be defined as a mesh with a stiffness that is proximate or greater than that of 304 grade stainless steel. The term "loosening-prone mesh," as used herein, shall be defined as a mesh with a stiffness substantially less than that of a loosening-resistant mesh.

The new drain cover can provide some or all of the features described above while also being constructed in a manner that is cost effective and suitable for mass production.

A drain cover assembly is disclosed for use in a drainage system comprising an underground catch basin or an underground flow conduit. The drain cover assembly may comprise: a drain cover having an upper surface and lower surface, the drain cover comprising a zone around its perimeter and a grating grid within the zone, wherein the perimeter zone comprises a channel, and wherein the grating grid comprises a plurality of grating members defining openings in between, wherein the openings are configured to permit a liquid to flow into the underground catch basin or the underground flow conduit, wherein the drain cover is configured to be connected to the underground catch basin or to the underground flow conduit proximate to its lower surface; a channel cover ring having an upper surface and a lower surface, wherein the lower surface of the channel cover ring comprises a shape to mate with a shape of the channel to allow the channel cover ring to be connected to the drain cover; means for connecting the channel cover ring to the drain cover; and a mesh cover, wherein the mesh cover is configured to cover the grating grid at the upper surface of the drain cover, and wherein a periphery of the mesh cover is configured to be fixed within the channel when the channel cover ring is connected to the drain cover.

In one example, the channel is on the upper surface of the drain cover. In one example, the channel is recessed in the upper surface of the drain cover. In one example, the upper surface of the channel cover ring is flush with the upper surface of the drain cover when the channel cover ring is connected to the drain cover. In one example, the periphery of the mesh cover is configured to be fixed within the channel between the channel cover ring and the drain cover. In one example, the drain cover is configured to connect to the underground catch basin or to the underground flow conduit via contact between the lower surface and a shoulder of the underground catch basin or the underground flow conduit. In one example, the drain cover comprises an extension at its lower surface, wherein the drain cover is configured to connect to the underground catch basin or to the underground flow conduit by positioning the extension within or around the underground catch basin or the underground flow conduit. In one example, the extension connects within or around the underground catch basin or the underground flow conduit using a friction fit. In one example, the means for connecting the channel cover ring to the drain cover comprises screws. In one example, the means for connecting the channel cover ring to the drain cover comprises a mechanical snap connection between the channel cover ring and the drain cover. In one example, the means for connecting the channel cover ring to the drain cover comprises a friction fitting connection between the channel cover ring and the drain cover. In one example, the means for connecting the channel cover ring to the drain cover comprises a latch, a clamp, a band, or an adhesive. In one example, the means for connecting the channel cover ring to the drain cover comprises a melted connection between the channel cover ring and the drain cover. In one example, the assembly further comprises a gasket, wherein the gasket is positioned within the channel to assist in fixing the periphery of the mesh cover within the channel. In one example, the lower surface of the channel cover ring comprises a groove to hold the gasket in place. In one example, the drain cover assembly is configured for use in outdoor or indoor drainage system applications. In one example, the drain cover assembly is configured for use in collecting and filtering drainage water or wastewater. In one example, the channel is comprised of a plurality of sub-channels. In one example, the channel cover ring comprises a single ring-shaped piece. In one example, the channel cover ring comprises a plurality of pieces.

DETAILED DESCRIPTION

The new drain cover invention disclosed herein may be embodied in various forms, some of which are described in this section. There exist other variations which are not described in this section but would be apparent to those familiar with the art. It shall be understood that these variations may be made without departing from the novel features of the disclosed invention.

Figure 1:
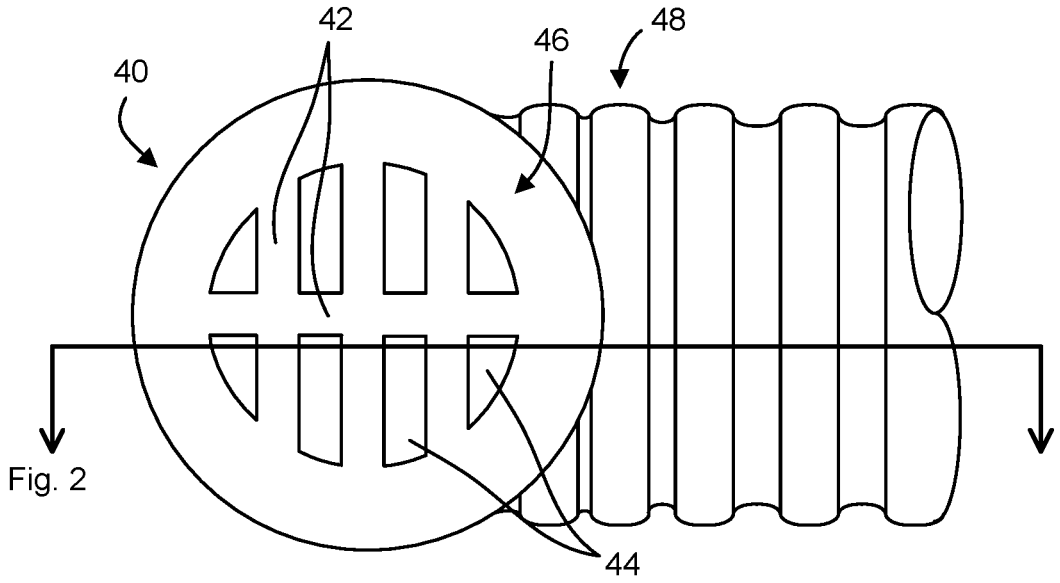
FIG. 1 (PRIOR ART)
FIGS. 1 and 2 depict an example of a prior art outdoor flat drain cover and flow conduit.
Figure 2:
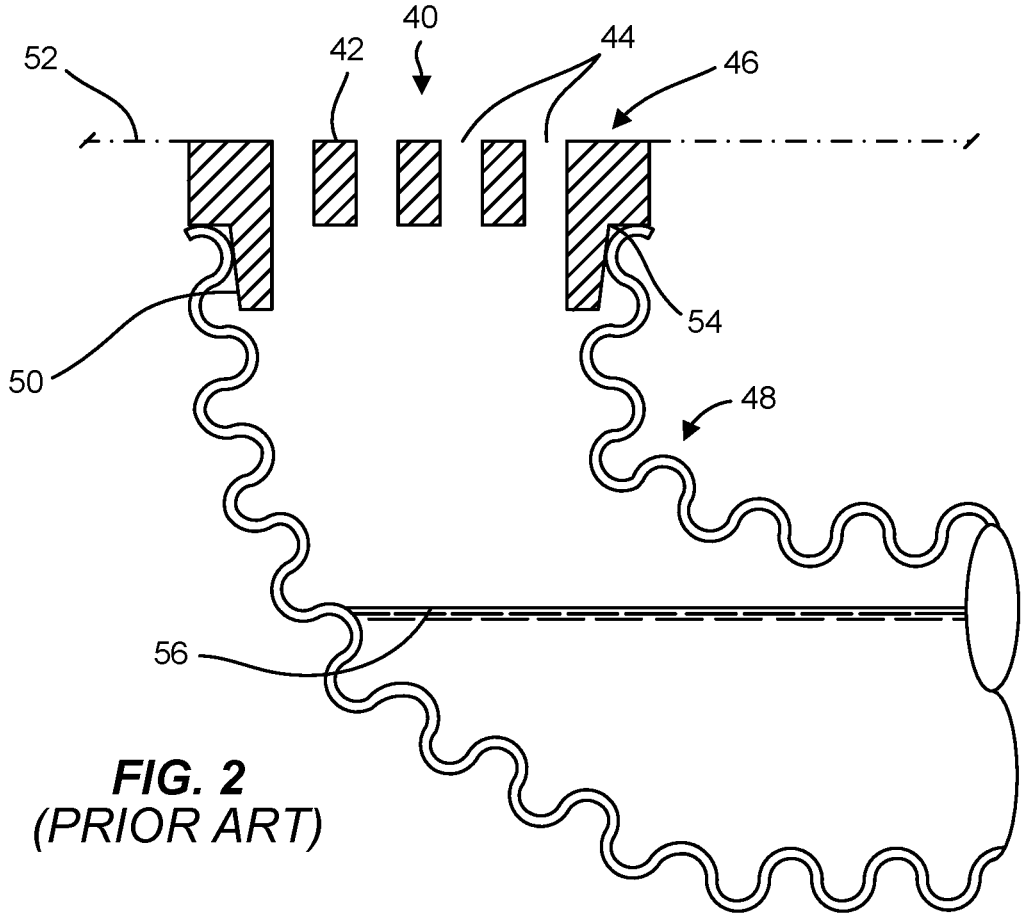
FIG. 2 (PRIOR ART)
Figure 3:
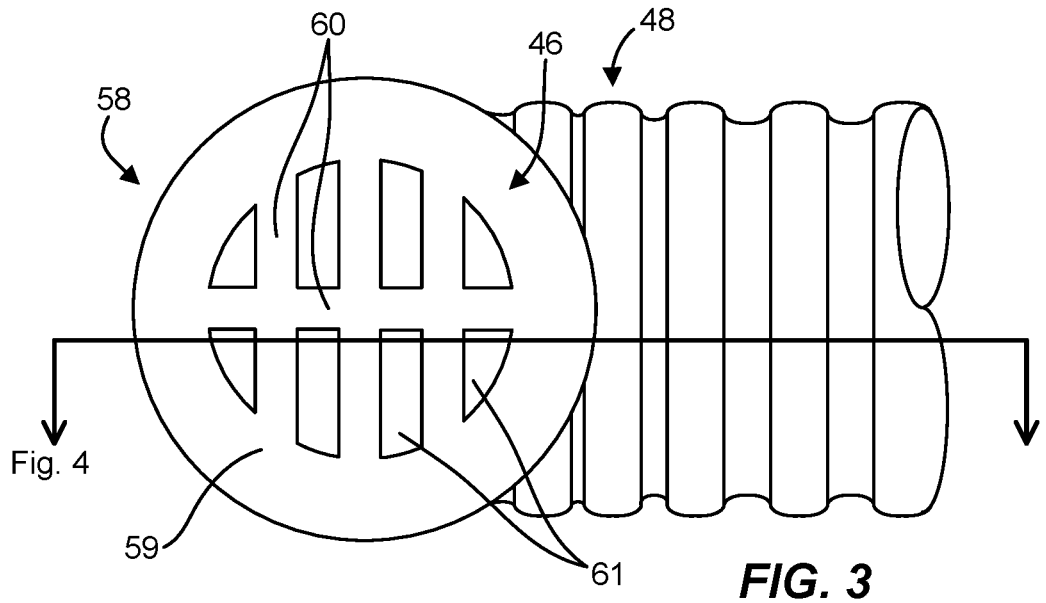
FIG. 3 (PRIOR ART)
FIGS. 3 and 4 depict an example of a prior art outdoor raised drain cover and flow conduit.
Figure 4:
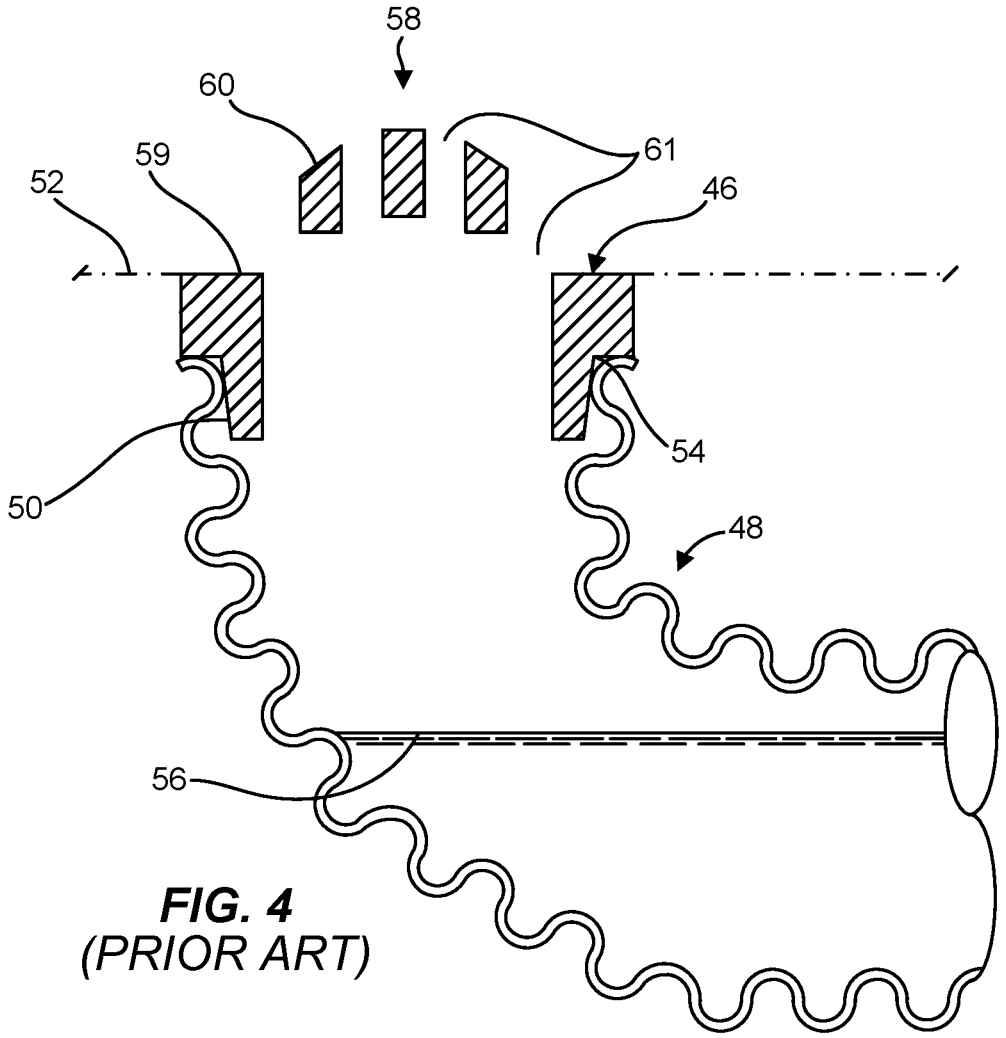
FIG. 4 (PRIOR ART)
Figure 5:
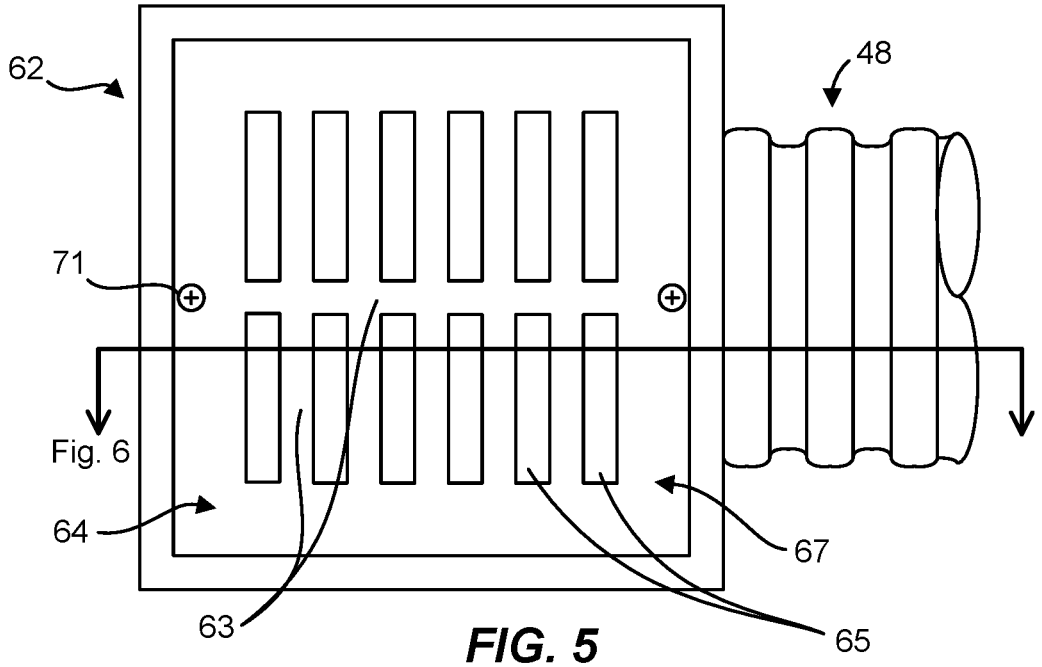
FIG. 5 (PRIOR ART)
FIGS. 5 and 6 depict an example of a prior art outdoor flat drain cover, catch basin, and flow conduit.
Figure 6:
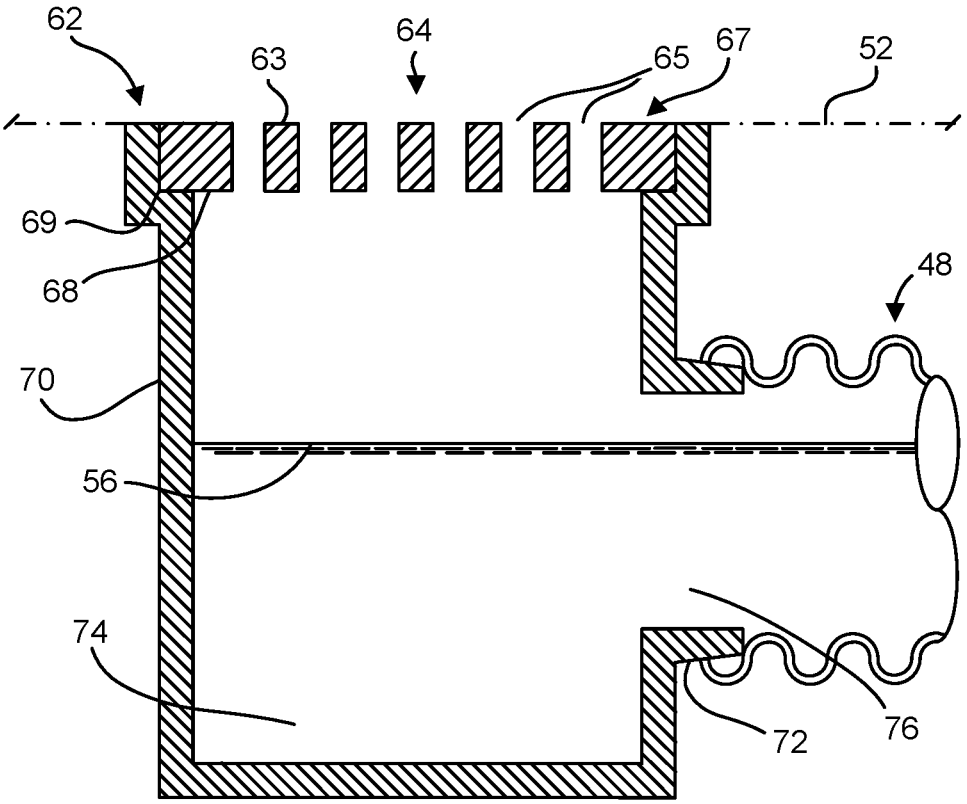
FIG. 6 (PRIOR ART)
Figure 7:
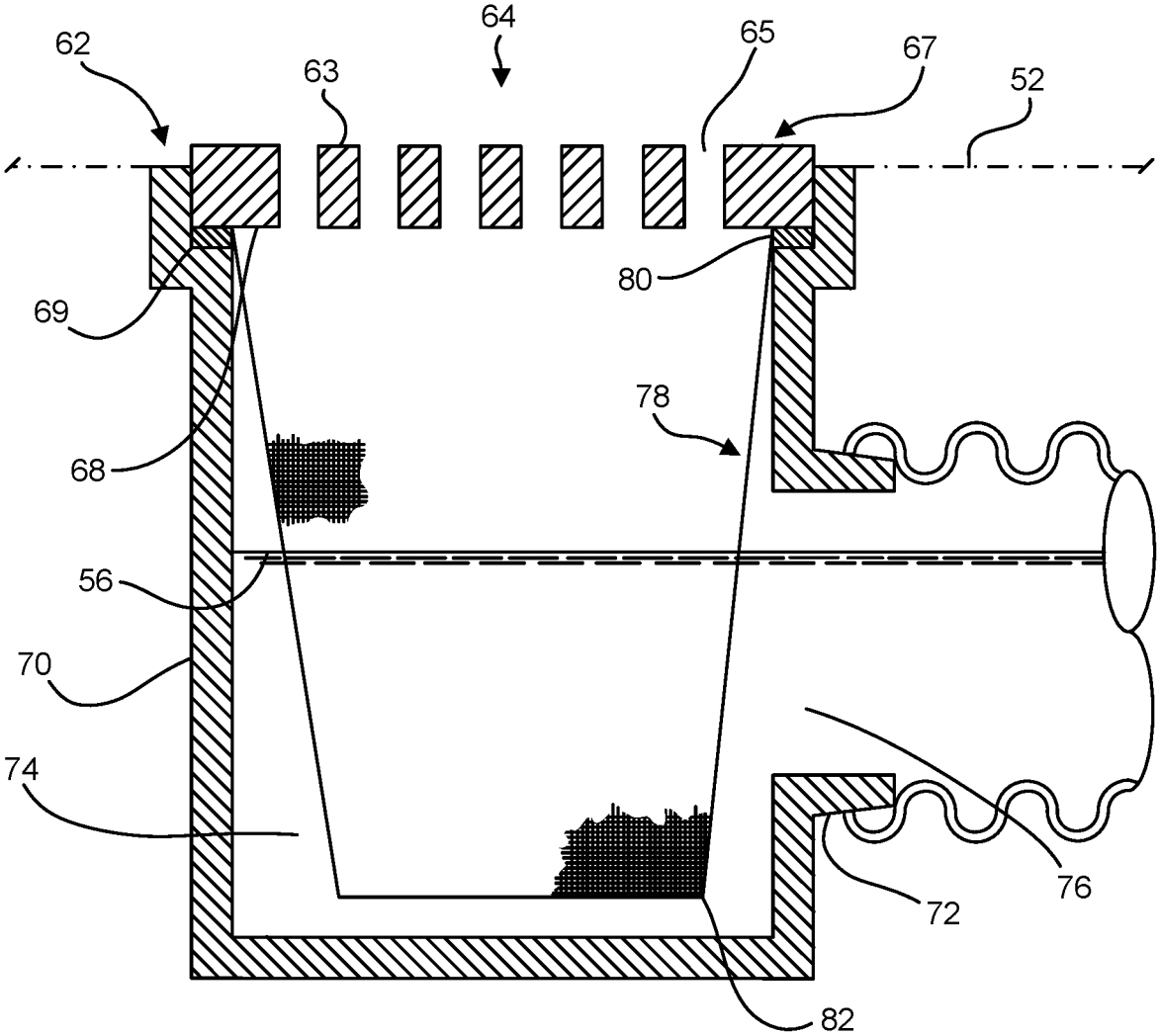
FIG. 7 (PRIOR ART)
FIG. 7 is cross-sectional view of the components shown in FIGS. 5 and 6 with the addition of a filter basket.
Figure 8:
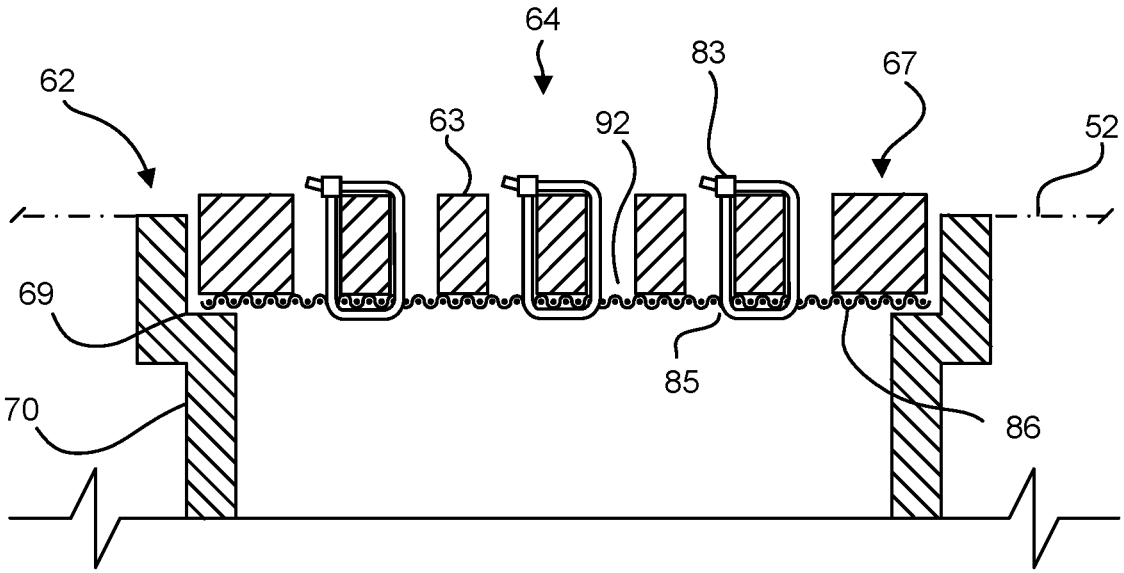
FIG. 8 (PRIOR ART)
FIG. 8 is cross-sectional view of one example of a prior art outdoor meshed drain cover assembly.
Figure 9:
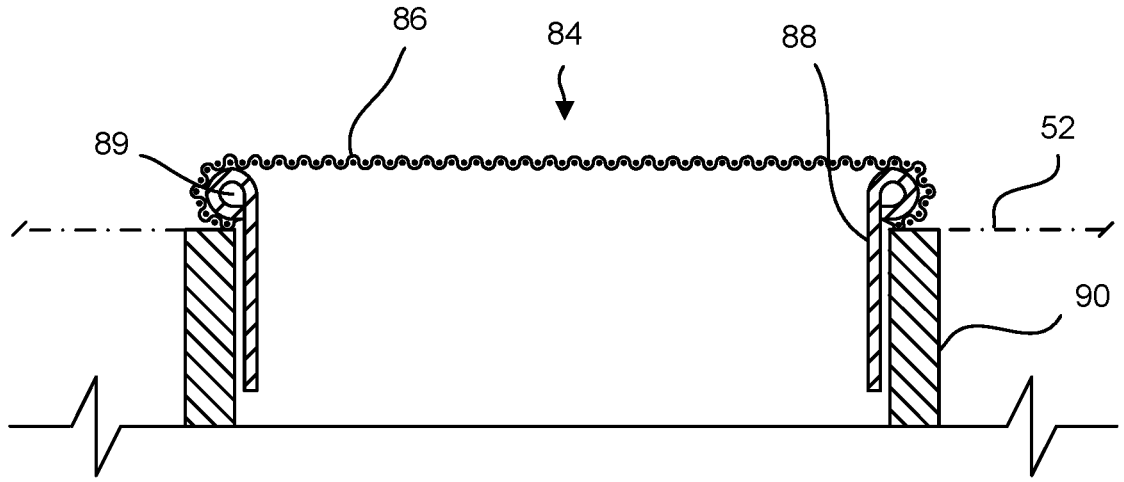
FIG. 9 (PRIOR ART)
FIG. 9 is cross-sectional view of another example of a prior art outdoor meshed drain cover assembly.
Figure 10:
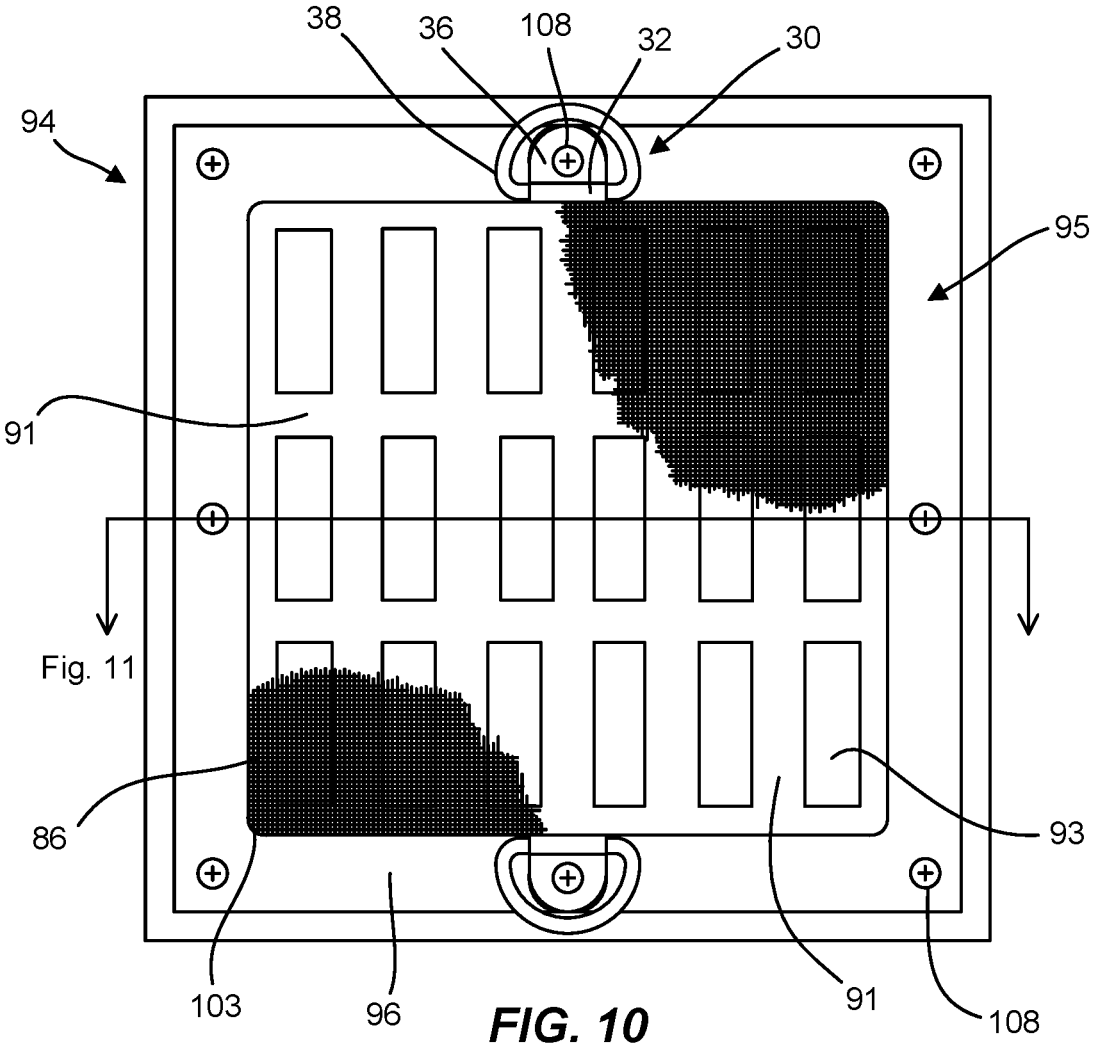
FIGS. 10 and 11 depict an embodiment of an outdoor flat drain cover constructed according to the present invention.
Figure 11:
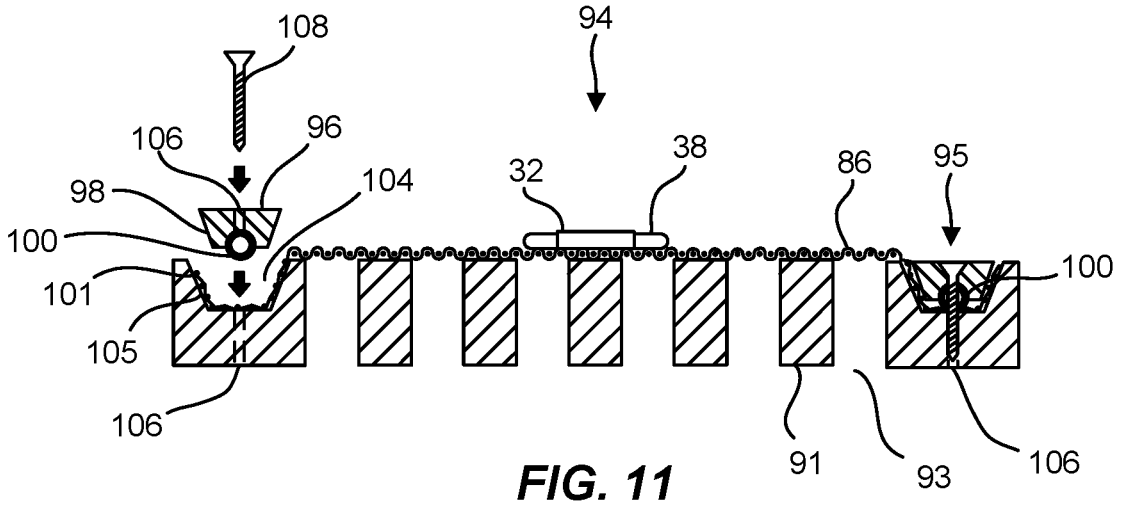

One illustrative embodiment of the invention is shown in FIGS. 10 and 11. In this embodiment, an outdoor square drain cover 94 with a flat profile is shown retaining a mesh 86 material on its outside upper surface via a mesh retaining channel 104, channel cover ring 96, spline gasket 100, and channel cover screws 108. The mesh retaining channel 104 is integrated into the drain cover's perimeter zone 95.

The mesh 86 material utilized in this embodiment is composed of metallic aluminum wire. Aluminum wire mesh 86 is inexpensive and offers basic resistance to tearing and weathering. Aluminum wire mesh 86 is widely available in standard forms with mesh opening sizes small enough to inhibit the passage of mosquito insects and debris (both fine and bulky types), while also being large enough to allow water to freely permeate it. A metallic type of mesh 86 material is generally preferable for use in the present invention, as the mesh 86 can retain a shape after being cut and die formed, thus enabling the assembly process of the drain cover 94 and mesh 86 to be optimized. Some example mesh 86 opening sizes that may be utilized in the present invention include 18×16, 18×14, 16×16 with 0.011" gauge or similar wire diameter. These mesh 86 sizes all share a common opening size dimension approximately less than 1/16", which is known to be generally effective in preventing the passage of the adult *Aedes aegypti* mosquito. Larger sizes of mesh 86 may be utilized for applications where exclusion of small mosquitos is not of concern. Metallic forms of mesh 86 may be utilized in an uncoated "mill finish" state (if a metallic look is desired) or alternatively may be colorized with an epoxy or powder coating for aesthetics.

The channel 104 is preferably located on top of the drain cover's perimeter zone 95, as shown in the illustration. In other possible embodiments the location of the channel 104 may instead be placed on the outer sides or bottom of the perimeter zone 95. The channel 104 may vary in manner of shape and size but is preferably shaped with a flat bottom and outwardly angled sides 105 for receiving the channel cover ring 96, which also has outwardly angled sides 98. A hollow and flexible spline type gasket 100 is retained and partially embedded by friction fitting in a cavity on the underside of the channel cover ring 96. The spline gasket 100 is preferably composed of a rigid rubber or other similar polymer with a high friction coefficient. The spine gasket 100 is preferably circular in its cross sectional-shape, as shown, with a diameter typically in the range of 1/8" to 1/4". The spine gasket 100 preferably has axial ribbing on its outside surface to enhance its mesh 86 gripping ability.

The partial embedment of the spline gasket 100 in the underside of the channel cover ring 96 is advantageous, as it allows the assembly process of the drain cover 94 to be optimized with the spline gasket 100 and channel cover ring 96 being attached to the drain cover 94 in a pre-assembled state. The partial embedment of the spline gasket 100 in the channel cover ring 96 is also advantageous, as it enables the spline gasket 100 to be deformed inward while under compression, which in turn allows the surfaces of the channel cover ring 96 to be in closer contact with the surfaces of the channel 104.

The spline gasket 100 and channel cover ring 96 are inserted into the channel 104 and held in place by a plurality of channel cover screws 108. The channel cover screws 108 penetrate the base material of the channel cover ring 96 and perimeter zone 95 via screw guide holes 106. The channel cover screws 108 can penetrate the spline gasket 100 and mesh 86 without loss of performance. The force imposed by the tightening of the channel cover screws 108 encourages permanent fixity and tautness of the mesh 86 on the upper surface of the new drain cover 94 through several features acting in tandem. The tightening of the channel cover screws 108 creates a compressive force that sandwiches the spline gasket 100 and mesh 86 between the channel cover ring 96 and channel 104. The spline gasket 100 deforms while under this compressive load, and thus is the first line of compressive contact for fastening the mesh 86. The sides 105 of the channel 104 and the sides 98 the channel cover ring 96 are configured in their respective shapes to ensure that, at some point during the tightening of the channel cover screws 108, the deformation of the spline gasket 100 will be halted when the channel cover ring 96 reaches the point where its own sides 98 wedge with the sides 105 of the channel 104 and with the mesh 86 sandwiched in between. Thus, additional compressive contact for locking the mesh is added above to that which is already established by the compression of the spline gasket 100.

It shall be understood to those familiar with the art that a mechanical snap connection, a friction fitting connection—or one or more latches, clamps, bands, or adhesives, or a process that melts the components together—may be used as an alternative to channel cover screws 108 for securing the channel cover ring 98 and mesh 86 to the drain cover's perimeter zone 95. Additionally, use of a spline gasket 100, while preferred, is not necessary in all useful embodiments.

The individual features that positively enhance the fixity and tautness of the mesh 86 may be considered individual resistance mechanisms that prevent the sandwiched mesh 86 from loosening from the channel cover ring 96, spline gasket 100, and channel 104. To become loose the mesh 86 must itself deform in shape to inwardly slip around the shape of the channel cover ring 96. The mesh 86 of this example, being made from aluminum wire, is relatively deformable when compared to the mechanical properties of 304 grade stainless steel wire, and thus may be thought of as a loosening-prone type of mesh 86. It shall be understood that there is a relationship between this embodiment's use of the loosening-prone aluminum wire mesh 86 and the corresponding necessity to incorporate loosening-resistant features into the channel cover ring 96, spline gasket 100, and channel 104 (to prevent mesh 86 loosening).

In addition to the features described above, the wedge shape of the channel cover ring 96 also enables the manufacturing process of the drain cover to be optimized, as during the tightening of the channel cover screws 108 the mesh 86 is naturally drawn deeper into the channel 104 and thus becomes taut during assembly, as opposed to the need to artificially maintain tautness during the tightening of the channel cover screws 108. The inward-facing corners 103 of the channel 104 and channel cover ring 96 are preferably rounded in order not to puncture the mesh 86 during the channel cover screw 108 tightening process, particularly for embodiments that are flat in profile.

The metallic mesh 86, once cut to shape, may have residual sharp wires present on its frayed edges 101, which may be a hazard if handled without gloves. Addressing this problem, the channel 104 feature of the device is additionally advantageous, as it provides a means to isolate these frayed edges 101. Isolation of frayed edges 101 is less of a safety issue with other forms of non-metallic mesh material, like polyester, but is nonetheless still desirable for non-metallic mesh if only for the masking of frayed edges for aesthetic reasons. A metallic mesh 86 is preferable for use in the invention due to its mechanical robustness and ease of cleaning, as debris is more easily shed from a metallic wire mesh 86 versus one composed of polyester or other fibrous material. The channel cover ring 96 is preferably rigid to avoid localized deformation while under the compressive load of the tightened channel cover screws 108 or other means of connecting to the channel 104 in the drain cover.

For greatest economy, the new drain cover 94 is preferably composed of a polymer or composite material like HDPE (optionally, with UV resisting additives suitable for outdoor use). The new drain cover 94 can also be composed of weathering-resistant metallic material, like 304 or 316 grade stainless steels, which may be more suitable than HDPE for some applications. The channel cover ring 96 can be made of polymer, composite, or weathering-resistant metallic materials, like 304 or 316 grade stainless steels. The channel cover screws 108 are preferably composed of a weathering-resistant metallic material, like 304 or 316 grade stainless steel. The channel cover screws 108 may be utilized in an uncoated "mill finish" state or may feature a colored coating for aesthetics.

The drain cover 94 features a plurality of grating surface openings 93 located beneath the mesh 86. The width of the grating surface openings 93 of this example are 5/16" in width to qualify as both "heel safe" per industry practice and "ADA compliant" per the Americans with Disabilities Act. Also beneath the mesh 86 is a plurality of associated grating members 91 that can safely support a load applied to the upper surface of the drain cover 94. The grating member 91 grid is attached to (and supported by) the drain cover's perimeter zone 95. The drain cover's 94 open area can be made comparable to that of a conventional drain cover of similar dimensions by increasing the opening size of the grating surface openings 93 beneath the mesh to offset the approximately 30% reduction in open area caused by the presence of the thin mesh 86 wire that covers the drain cover's 94 surface. The location of the grating members 91 below the mesh 86 also reduces the likelihood of the mesh's 86 being deformed or torn by blunt impacts or heavy debris loads.

The drain cover 94 optionally also features collapsible lifting eyes 30 that permit the drain cover 94 to be ergonomically lifted without causing damage to the mesh 86. The lifting eyes 30 are preferably composed of a weathering-resistant metallic material like 304 or 316 grade stainless steel. The lifting eyes 30 may be utilized in an uncoated "mill finish" state or feature a colored coating for aesthetics. The lifting eyes 30 are composed of an attachment pad 36, a lifting ring 38, and a lifting ring socket 32. The lifting eye 30 of this example is secured to the surface of the drain cover 94 by the same screw 108 used to secure the channel cover ring 96. The lifting rings 38 can rotate within the lifting ring sockets 32 so that they may be used as a lifting point for the drain cover 94 and be collapsible (as shown) when not in use. In a collapsed state the lifting eyes 30 may slightly project beyond the surface of the drain cover 94, perhaps by 1/8", thus maintaining substantial flushness with the ground. In applications requiring complete flushness, it is possible to recess the lifting eye 30 within the drain cover's perimeter zone 95. As will be apparent to those familiar in the art, the drain cover 94 may also be configured to utilize other forms of lifting devices, both flush and non-flush, that may also be integrated into the perimeter zone 95 or channel cover ring 96, the upper surface of the drain cover 94, or the sides of the drain cover 94.

The channel cover ring 96 of this embodiment is shown as a single piece, but in other possible embodiments it could alternatively be composed of multiple pieces to overcome manufacturing or assembly limitations.

Figure 12:
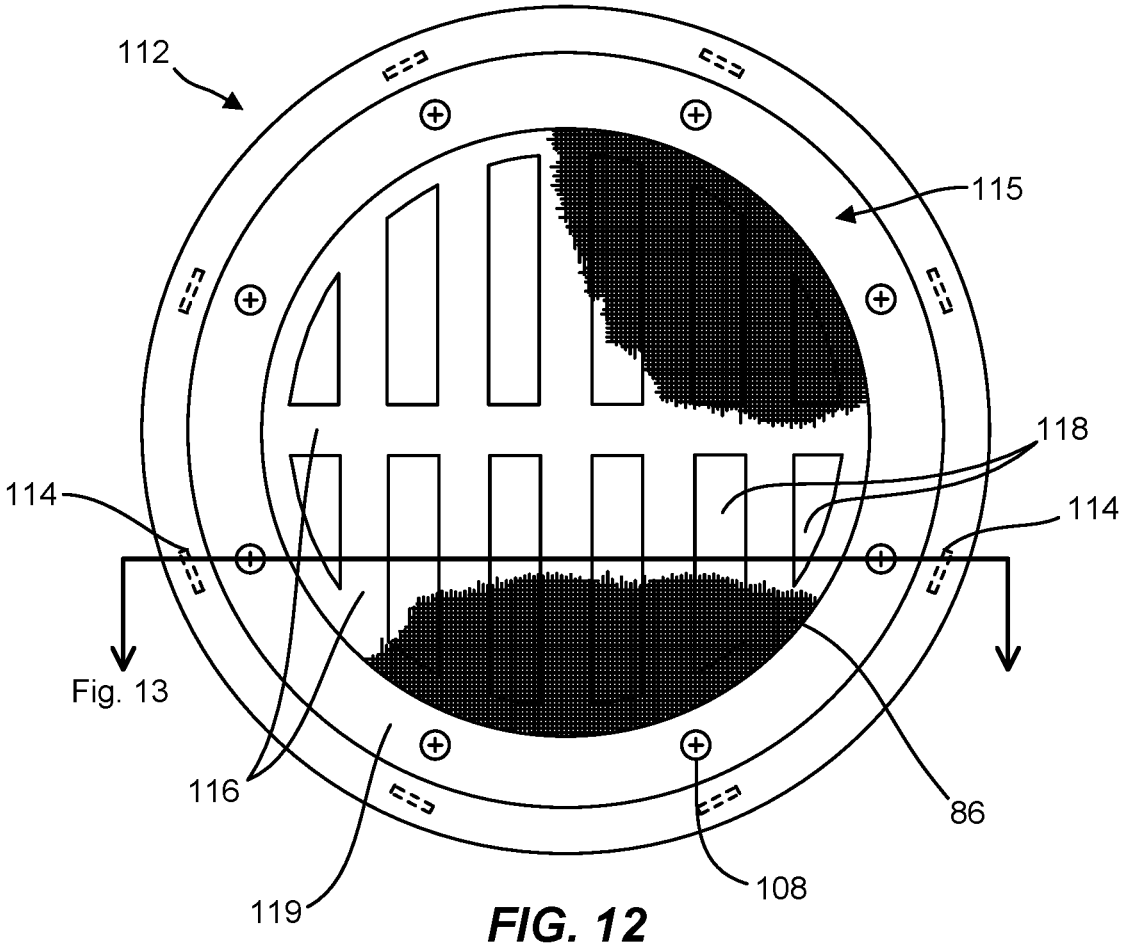
FIGS. 12 and 13 depict another embodiment of an outdoor raised drain cover constructed according to the present invention.
Figure 13:
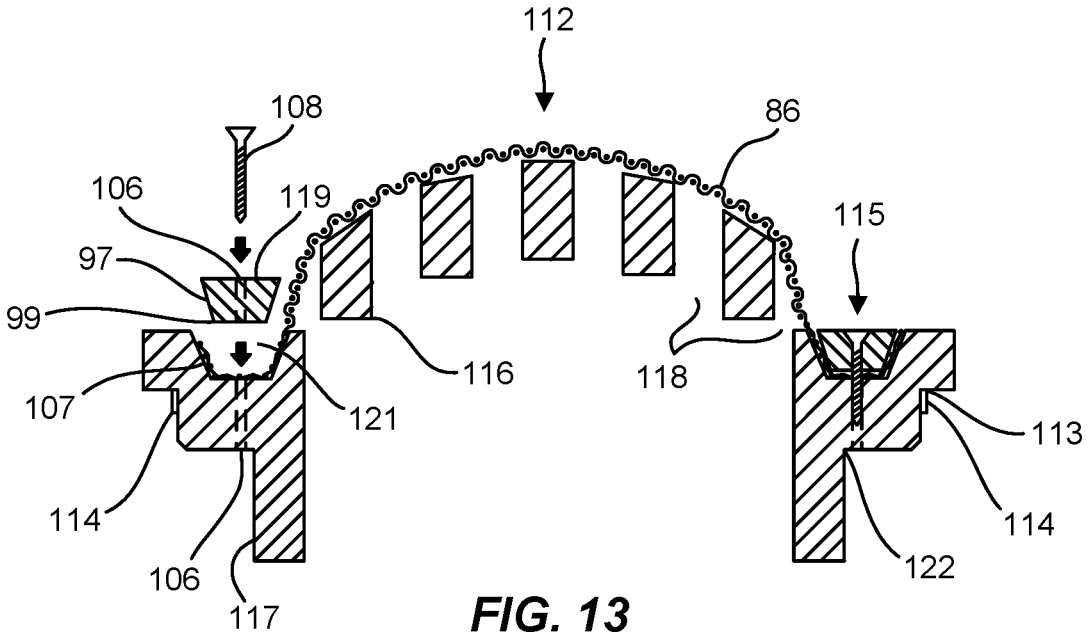

Another illustrative embodiment of the invention is shown in FIGS. 12 and 13. In this embodiment, an outdoor circular drain cover 112 with a hemispherical raised grating member 116 grid profile is shown with a mesh 86 cover on its upper surface. The mesh 86 is secured in a retaining channel 121 that is integrated into the drain cover's 112 perimeter zone 115. The mesh 86 shown in this embodiment is composed of 304 grade stainless steel. While 304 grade stainless steel mesh 86 material is more expensive than aluminum, it is also preferable for use in the present invention due to its increased strength, stiffness, and weathering-resistance. The increased strength and stiffness of 304 grade stainless steel mesh 86 offers enhanced resistance to its being deformed or punctured due to surface impacts (like falling hail) or surface loads (like foot traffic).

A further advantage of the increased strength and stiffness offered by 304 grade stainless steel mesh 86 is its inherently greater resistance to loosening when utilized in the present invention. As with the previous embodiment, to become loose the mesh 86 must itself deform in shape to slip around the shape of the channel cover ring 119. The mesh 86 of this example, being composed of 304 grade stainless steel wire, is more resistant to deformation than is a similar mesh 86 composed of aluminum wire. It shall be understood that the loosening-resistant mesh 86 of this embodiment requires fewer loosening-resistant features (incorporated into the channel cover ring 119 and channel 121) to provide sufficient mesh 86 fixity and tautness.

The channel cover ring 119 of this embodiment is similar in concept to that of the previous embodiment but is circular in shape to match the shape of the drain cover's 112 perimeter zone 115. The channel cover ring 119 also does not utilize a spline gasket 100 in this example, although it could. While the channel cover ring 119 of this embodiment is shown as a single piece, it could alternatively be composed of multiple pieces, as mentioned previously. Similar to the previous embodiment, the mesh 86 is fastened to the drain cover's 112 outside surface via the combined locking mechanisms of channel cover ring 119, channel cover screws 108, and wedge-shaped sides 97 & 107 of the channel cover ring 119 and channel 121. The downward facing edges 99 of the channel cover ring are sharp edged to increase the resistance to loosening, as it more difficult for the mesh 86 to slip around a sharp edge 99 than a rounded edge. This embodiment's use of loosening-resistant mesh 86 eliminates the need for a spline gasket 100 to be used in conjunction with the channel cover screws 108, channel cover ring 119, and retaining channel 121.

Beneath the mesh 86, the drain cover 112 features a plurality of grating surface openings 118 that are three dimensional in shape. The open area of the raised drain cover 112 of this example is greater than that of a circular flat drain cover of similar cross-sectional area (e.g., FIGS. 10 and 11). The preferable shape for the upper portion of a raised drain cover is either hemispherical or hemielliptsoidal, as these shapes are most favorable for generally maximizing the drain cover's available open area while minimizing the possibility of the mesh's 86 clumping (or folding over itself) as it is stretched over the raised upper surface during manufacturing. In other possible embodiments the shape of the raised portion of the new drain cover may be varied to include truncated types of cones, cylinders, half sections of other polyhedrons, and other similar shapes.

As has been previously indicated, it is preferable that the drain cover 112 be adaptable for retrofitting existing municipal, commercial, and residential drainage systems. To meet this goal, the underside of the perimeter zone 115 of this example features a known method for engaging the drain cover 112 on either a round catch basin or round-flow conduit pipe. An outermost shoulder 113 is intended for supporting the drain cover 112 on the ledge of a round catch basin. The small tabs 114 on the shoulder provide some amount of friction fit for engaging with the round catch basin. Alternatively, an innermost shoulder 122 is intended for optionally supporting the drain cover 112 on a round-flow conduit, with a smaller inside diameter than that of the catch basin. The lower neck extension 117 is intended to fit into the inside diameter of a flow conduit and be of sufficient length and relative size to ensure the drain cover fits snugly.

Figure 14:
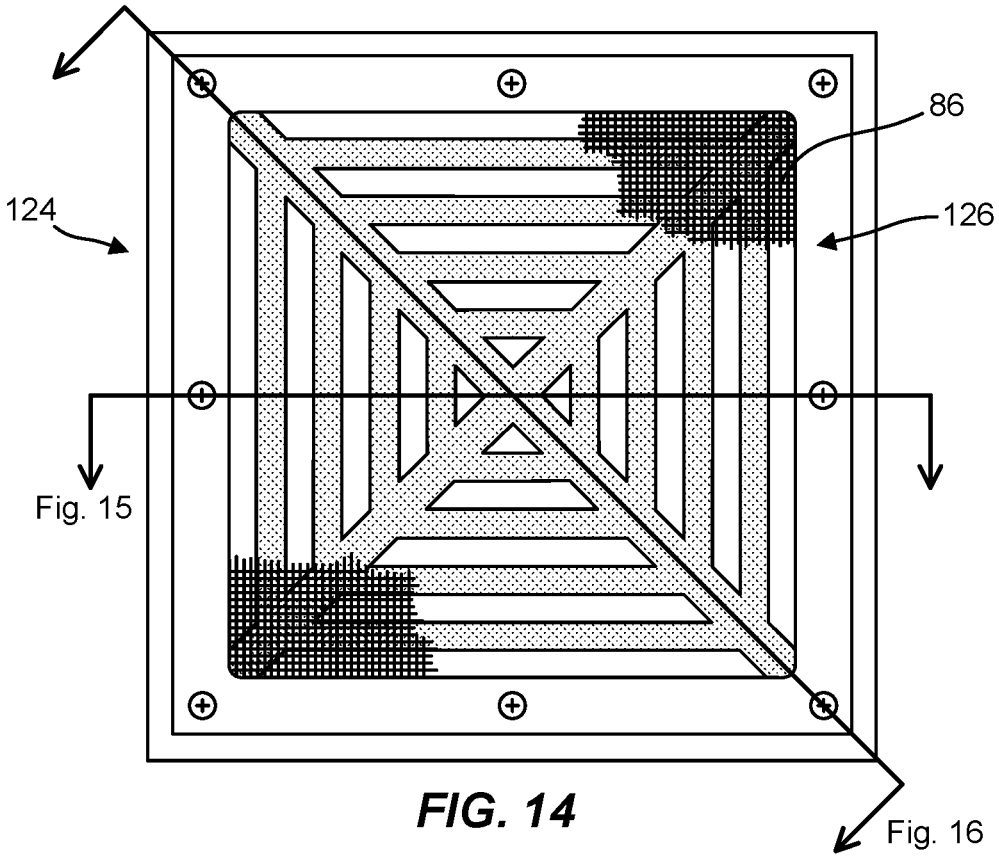
FIGS. 14-16 depict another embodiment of an outdoor raised drain cover constructed according to the present invention.
Figure 15:
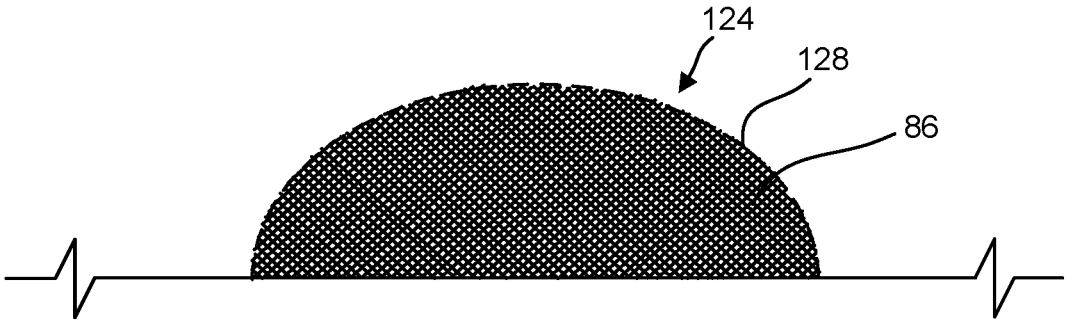
Figure 16:
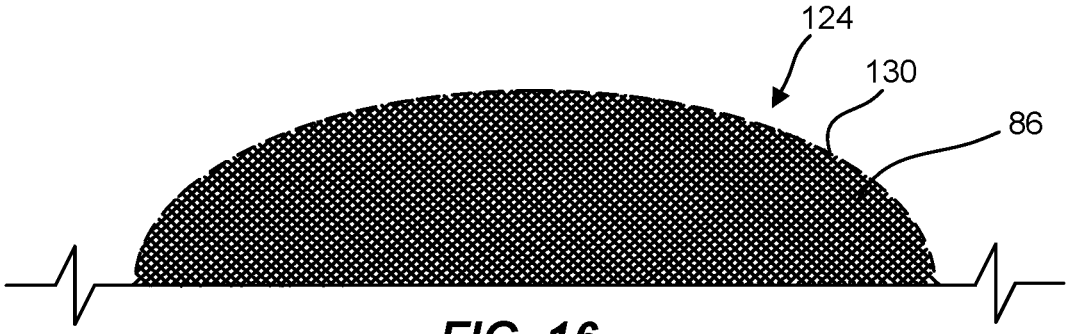

Another illustrative embodiment of the invention is shown in FIGS. 14-16. In this embodiment, an outdoor square drain cover 124 with a raised elliptical profile is shown with a mesh 86 cover on its outside surface. The mesh 86 is secured in a retaining channel that is integrated into the perimeter zone 126. As has been previously indicated, it is preferable to avoid mesh folding or clumping when fastening the mesh over a raised drain cover surface. A hemispherical profile is suitable profile for this purpose, but it is not able to occupy all the available surface area of a square drain cover, like the type shown in the present embodiment. As an alternative, the elliptically based profile shown in this embodiment may be used, in which the curved top profile is lofted to fully cover the square base shape. FIG. 15 shows a side view of the drain cover's 124 raised mesh-surface profile 128, which is hemielliptic its in shape. The preferred ratio of hemielliptic width to height is between 20% to 40%. FIG. 16 shows a diagonal side view of the drain cover 124. The elliptical profile 130, along the diagonal view, is the same height as that of the previous figure but is elongated in width to maximize the available open area of the square drain cover.

Figure 17:
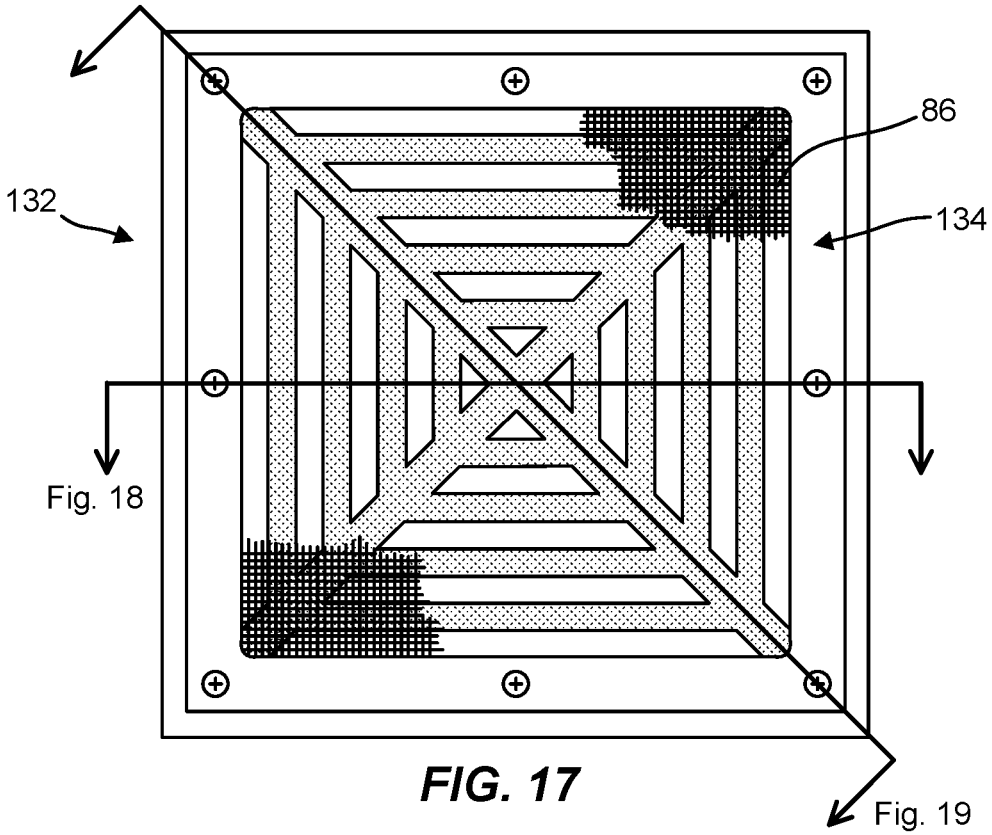
FIGS. 17-19 depict another embodiment of an outdoor raised drain cover constructed according to the present invention.
Figure 18:
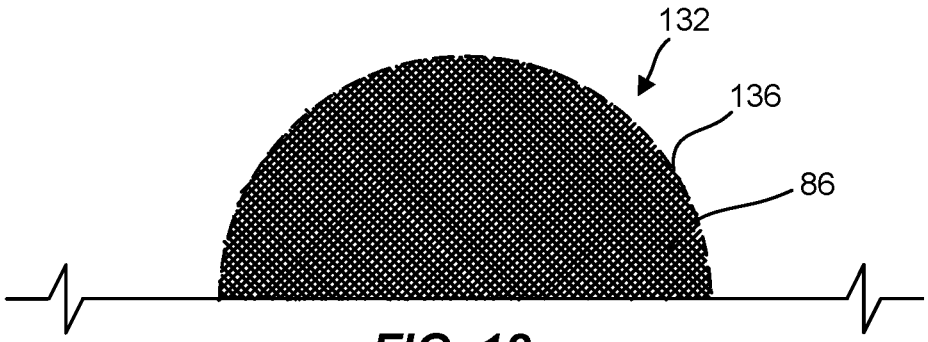
Figure 19:
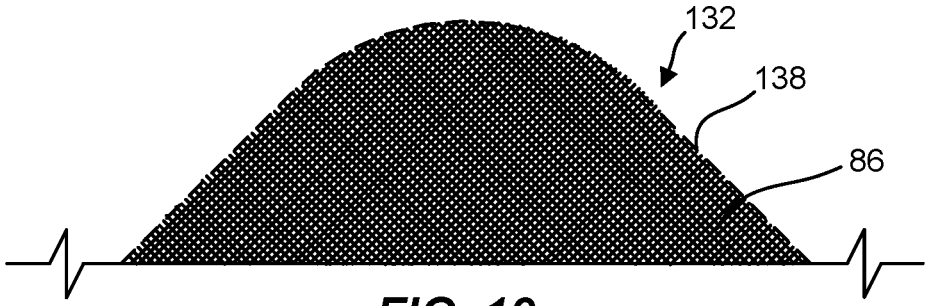

Another illustrative embodiment of the invention is shown in FIGS. 17-19. In this embodiment, an outdoor square drain cover 132 with a modified hemispherical profile is shown with a mesh 86 cover on its outside surface. The mesh 86 is secured in a retaining channel that is integrated into the perimeter zone 134. As has been previously indicated, it is preferable to avoid mesh folding or clumping when fastening the mesh over a raised drain cover surface. A hemispherical profile is suitable for this purpose, but that profile is not able to occupy all the available surface area of a square drain cover, like the type shown in the present embodiment. As an alternative, the modified hemispherical based profile shown in this embodiment may be used, as its curved upper surface is lofted to fully cover the square base shape. FIG. 18 shows a side view of the drain cover's 132 raised mesh surface profile 136 as being hemispherical in its shape. FIG. 19 shows a diagonal side view of the drain cover 132. The modified hemispherical profile 138 along the diagonal view is the same height as that of the previous figure but is elongated in its width with tangent lines to maximize the available open area of the square drain cover.

Figure 20:
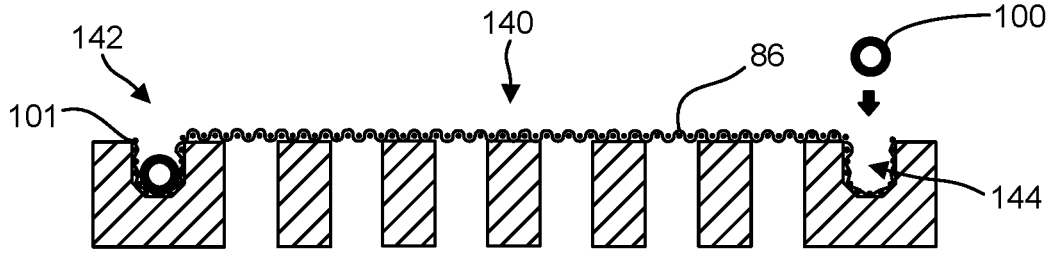
FIGS. 20-23 depict different additional embodiments of an outdoor flat drain cover constructed according to the present invention.

Another illustrative embodiment of the invention is shown in FIG. 20. In this embodiment, an outdoor flat drain cover 140 is shown in cross section with a mesh 86 cover on its outside surface. The mesh 86 is secured in a retaining channel 144 integrated into the perimeter zone 142. The mesh 86 is retained in the channel 144 by the friction fitting of a hollow spline gasket 100. The channel's 144 width and depth are sufficiently narrow to require the spline gasket 100 to be compressed and deformed upon insertion. This embodiment is less preferable to those previously shown in FIG. 11 and FIG. 13, as it lacks the more favorable mesh-retaining characteristics imparted by a channel cover ring and tightening screws shown in previous embodiments. This embodiment is also less preferable to those previously shown, as it lacks a means of isolating and masking the frayed edges 101 of the mesh 86.

Figure 21:
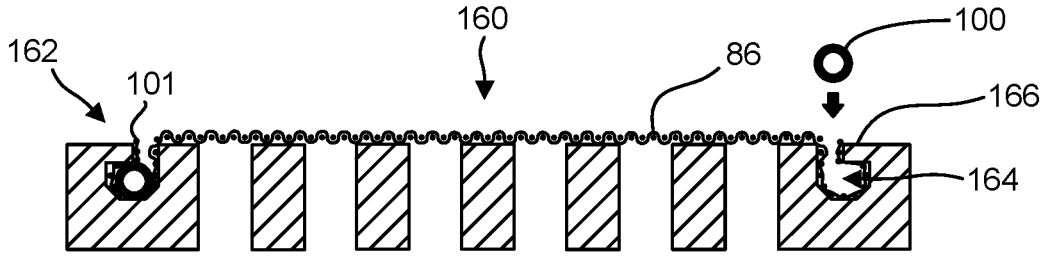

Another illustrative embodiment of the invention is shown in FIG. 21. In this embodiment, an outdoor flat drain cover 160 is shown with a mesh 86 cover on its outside surface. The mesh 86 is secured in a retaining channel 164 that is integrated into the perimeter zone 162. The mesh 86 is retained in the channel 164 by the friction fitting of a hollow spline gasket 100. The channel's 164 width and depth are sufficiently narrow to require the spline gasket 100, upon insertion, to be compressed and deformed. Additionally, the channel 164 features a channel geometry modification 166 to encourage additional mesh 86 fixity by trapping the spline gasket 100. However, this embodiment's channel 164 configuration is again less preferable to those previously shown in FIG. 11 and FIG. 13, as it lacks the more favorable mesh-retaining features shown in those embodiments. This embodiment is also less preferable for its lack of a means of isolate the frayed edges 101 of the mesh 86.

Figure 22:
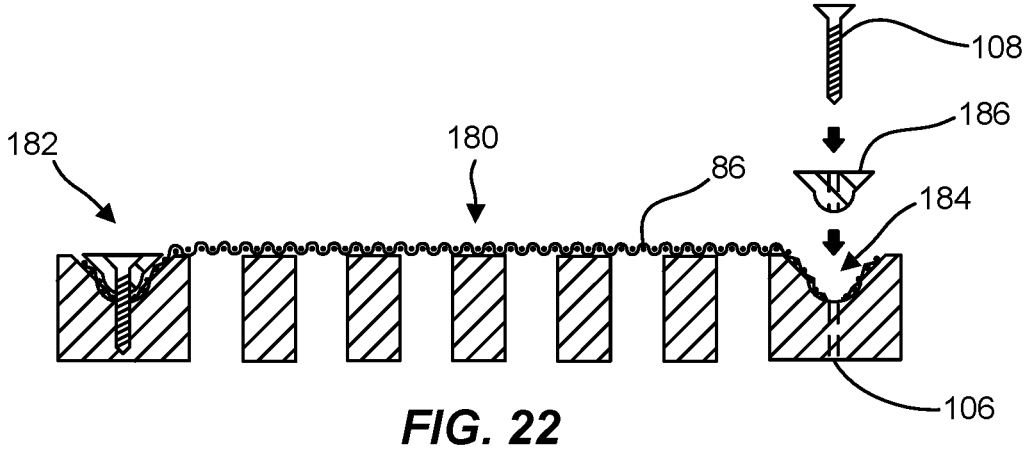

Another illustrative embodiment of the invention is shown in FIG. 22. In this embodiment, an outdoor flat drain cover 180 is shown with a mesh 86 cover on its outside surface. The mesh 86 is secured in a retaining channel 184 that is integrated into the perimeter zone 182. The mesh 86 is retained in the channel 184 by the compressive force imparted by a channel cover ring 186 and tightening channel cover screws 108. This embodiment is less preferable to those previously shown in FIG. 11 and FIG. 13, as it lacks the more favorable mesh-retaining features shown in those embodiments, particularly in conjunction with loosening-prone types of mesh 86. The relatively shallow channel 184 of this embodiment and lack of downward-facing sharp corners on the channel cover ring 186 results in a meshed drain cover assembly with a lesser resistance to mesh 86 loosening.

Figure 23:
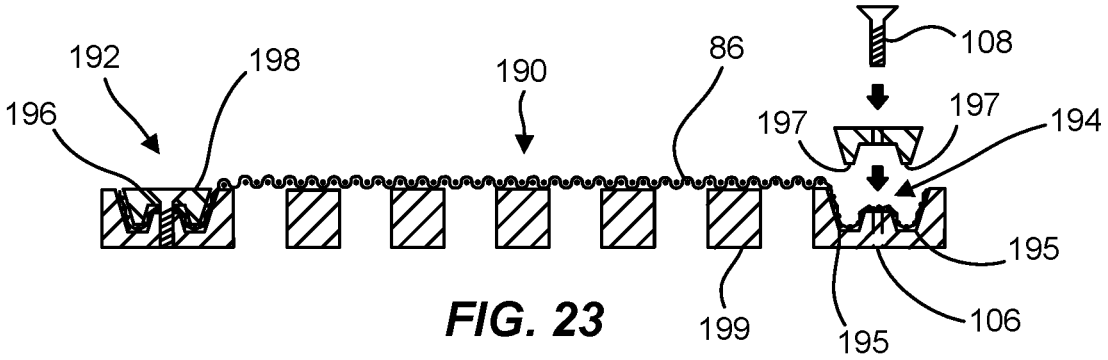

Another illustrative embodiment of the invention is shown in FIG. 23. This embodiment features an indoor flat drain cover 190 with a mesh 86 cover on its outside surface, although this embodiment could be used outside as well. The mesh 86 is secured in a retaining channel 194 that is integrated into the perimeter zone 192. The channel 194 is itself composed of two sub-channels 195. The mesh 86 is retained in the channel 194 by the compressive force imparted by a channel cover ring 198 and tightened channel cover screws 108. The multiple sharp-edged interlocking tongue extensions 197 on the underside of the channel cover ring 198 mate with the sub-channels 195 of the channel 194. This embodiment's use of sub-channels 195 and sharp-edged interlocking tongue extensions 197 results in a meshed drain cover assembly with an increased resistance to mesh 86 loosening. This embodiment's use of multiple sub-channels 195 also permits the drain cover 190 to become more compact in its thickness, which is a preferable feature for indoor drainage systems that favor a more flush surface profile. As is known to those familiar in the art, indoor drainage system components are often composed of highly corrosion-resistant materials, like 316 grade stainless steel or bronze, to avoid discoloration or corrosion when exposed to indoor cleaning agents. The mesh 86 material utilized in this embodiment is composed of 316 stainless steel, which has mechanical properties proximate to those of 304 stainless steel. Likewise, the channel cover ring 198 and the drain cover 190 are also composed of 316 stainless steel material. This use of a metallic drain cover material further enables the embodiment to take on a form of compact thickness, as the material strength of the grating member 199 grid is greater than a similar one composed of HDPE, and thus this embodiment requires less thickness for supporting a surface load.

What is claimed is:

1. A drain cover assembly for use in a drainage system comprising an underground catch basin or an underground flow conduit, comprising:

a drain cover having an upper surface and lower surface, the drain cover comprising a zone around its perimeter and a grating grid within the zone, wherein the perimeter zone comprises a channel, and wherein the grating grid comprises a plurality of grating members defining openings in between, wherein the openings are configured to permit a liquid to flow into the underground catch basin or the underground flow conduit, wherein the drain cover is configured to be connected to the underground catch basin or to the underground flow conduit proximate to its lower surface;

a channel cover ring having an upper surface and a lower surface, wherein the lower surface of the channel cover ring comprises a shape to mate with a shape of the channel to allow the channel cover ring to be connected to the drain cover;

means for connecting the channel cover ring to the drain cover; and a mesh cover, wherein the mesh cover is configured to cover the grating grid at the upper surface of the drain cover, and wherein a periphery of the mesh cover is configured to be fixed within the channel when the channel cover ring is connected to the drain cover.

2. The drain cover assembly of claim 1, wherein the channel is on the upper surface of the drain cover.

3. The drain cover assembly of claim 2, wherein the channel is recessed in the upper surface of the drain cover.

4. The drain cover assembly of claim 1, wherein the upper surface of the channel cover ring is flush with the upper surface of the drain cover when the channel cover ring is connected to the drain cover.

5. The drain cover assembly of claim 1, wherein the periphery of the mesh cover is configured to be fixed within the channel between the channel cover ring and the drain cover.

6. The drain cover assembly of claim 1, wherein the drain cover is configured to connect to the underground catch basin or to the underground flow conduit via contact between the lower surface and a shoulder of the underground catch basin or the underground flow conduit.

7. The drain cover assembly of claim 1, wherein the drain cover comprises an extension at its lower surface, wherein the drain cover is configured to connect to the underground catch basin or to the underground flow conduit by positioning the extension within or around the underground catch basin or the underground flow conduit.

8. The drain cover assembly of claim 7, wherein the extension connects within or around the underground catch basin or the underground flow conduit using a friction fit.

9. The drain cover assembly of claim 1, wherein the means for connecting the channel cover ring to the drain cover comprises screws.

10. The drain cover assembly of claim 1, wherein the means for connecting the channel cover ring to the drain cover comprises a mechanical snap connection between the channel cover ring and the drain cover.

11. The drain cover assembly of claim 1, wherein the means for connecting the channel cover ring to the drain cover comprises a friction fitting connection between the channel cover ring and the drain cover.

12. The drain cover assembly of claim 1, wherein the means for connecting the channel cover ring to the drain cover comprises a latch, a clamp, a band, or an adhesive.

13. The drain cover assembly of claim 1, wherein the means for connecting the channel cover ring to the drain cover comprises a melted connection between the channel cover ring and the drain cover.

14. The drain cover assembly of claim 1, further comprising a gasket, wherein the gasket is positioned within the channel to assist in fixing the periphery of the mesh cover within the channel.

15. The drain cover assembly of claim 14, wherein the lower surface of the channel cover ring comprises a groove to hold the gasket in place.

16. The drain cover assembly of claim 1, wherein the drain cover assembly is configured for use in outdoor or indoor drainage system applications.

17. The drain cover assembly of claim 1, wherein the drain cover assembly is configured for use in collecting and filtering drainage water or wastewater.

18. The drain cover assembly of claim 1, wherein the channel is comprised of a plurality of sub-channels.

19. The drain cover assembly of claim 1, wherein the channel cover ring comprises a single ring-shaped piece.

20. The drain cover assembly of claim 1, wherein the channel cover ring comprises a plurality of pieces.

* * * * *